US008217968B2

(12) United States Patent
Sano et al.

(10) Patent No.: US 8,217,968 B2
(45) Date of Patent: Jul. 10, 2012

(54) IMAGE DISPLAY DEVICE

(75) Inventors: Yuma Sano, Tokyo (JP); Ryosuke Nonaka, Kawasaki (JP); Masahiro Baba, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 497 days.

(21) Appl. No.: 12/560,608

(22) Filed: Sep. 16, 2009

(65) Prior Publication Data

US 2010/0182346 A1 Jul. 22, 2010

(30) Foreign Application Priority Data

Jan. 16, 2009 (JP) ..... 2009-8140

(51) Int. Cl.
*G09G 5/10* (2006.01)

(52) U.S. Cl. ..... 345/690; 345/102

(58) Field of Classification Search ..... None
See application file for complete search history.

(56) References Cited

U.S. PATENT DOCUMENTS

2007/0268242 A1 11/2007 Baba et al.
2008/0074372 A1 3/2008 Baba et al.
2009/0002285 A1 1/2009 Baba et al.
2009/0115907 A1 5/2009 Baba et al.
2009/0140975 A1 6/2009 Nonaka et al.
2009/0201245 A1 8/2009 Nonaka et al.
2009/0295783 A1 12/2009 Baba et al.
2010/0053066 A1 3/2010 Nonaka et al.
2010/0079476 A1 4/2010 Baba et al.
2010/0149224 A1 6/2010 Baba et al.
2010/0238201 A1 9/2010 Nonaka et al.
2011/0012824 A1 1/2011 Nonaka et al.

FOREIGN PATENT DOCUMENTS

JP 2003-099010 4/2003
JP 2004-325628 11/2004
JP 2010-054839 3/2010
WO 2009/054527 A1 4/2009

*Primary Examiner* — Jason Olson
(74) *Attorney, Agent, or Firm* — Turocy & Watson, LLP

(57) ABSTRACT

An image display device 100 is an image display device capable of controlling the luminance of a backlight. The image display device 100 includes: a backlight luminance set value estimator which calculates the luminance set value of a backlight 101 based on an input image; and a signal corrector which corrects the transmittance of a liquid crystal in accordance with the luminance distribution of backlight emitted to the liquid crystal panel. The image display device 100 is characterized in that a signal corrector 107 corrects the transmittance of the liquid crystal while retaining the proportion of a gray-scale level value of each of RGB subpixels of the input image.

5 Claims, 9 Drawing Sheets

IMAGE DISPLAY DEVICE

CROSS REFERENCE TO RELATED APPLICATIONS

This application is based upon and claims the benefit of priority from the prior Japanese Patent Application No. 2009-8140, filed on Jan. 16, 2009, the entire contents of which are incorporated herein by reference.

BACKGROUND OF THE INVENTION

1. Field of the Invention

The present invention relates to an image display device having a backlight capable of controlling light intensity.

2. Related Art

In recent years, a technique to modulate the backlight luminance of a liquid crystal display in accordance with video signals has been studied in order to improve the contrast of the image to be displayed and to reduce power consumption.

When modulating the backlight luminance, liquid crystal transmittance has to be corrected in accordance with the luminance of backlight emitted to a liquid crystal panel in order to maintain the luminance of the image to be displayed. When the backlight luminance value is set low, there is a case where a gray-scale level value which has been corrected in accordance with a backlight luminance value to control the liquid crystal transmittance exceeds a displayable value of the liquid crystal panel. Therefore, in various disclosed techniques, when the gray-scale level value corrected in accordance with the backlight luminance value exceeds the displayable value of the liquid crystal panel, the gray-scale level value of a corrected image exceeding a displayable range is corrected to be the maximum displayable value, or a rounding gray-scale level correction process (see JP-A 2004-325628 (Kokai), for example) is performed. However, in these techniques, there is a problem that the color tone of the image to be displayed is drifted for the input video signal.

Further, a method to prevent the color drift between the color tone of the display image and that of the input image has been investigated (see JP-A 2003-99010 (Kokai), for example). Such a method includes the steps of: detecting the maximum peak level from the peak levels of RGB colors of the input image signal; calculating an image gain based on the maximum peak level; amplifying the input image signal in accordance with the image gain; and modulating the backlight luminance in accordance with the image gain. In these techniques, all signals of the input image are amplified at one time in accordance with the image gain while the luminance of the backlight is modulated. Accordingly, the backlight has to emit light having the determined luminance level to liquid crystal panel wholly and equally in order to display an image having desired luminance and color. However, when a plurality of backlights are arranged in each area, the emission distribution of backlight in the screen is not equalized and an image having desired luminance and color cannot be displayed. Further, since the backlight luminance is set in accordance with the maximum peak level of the input signal, the backlight luminance tends to be set at a brighter level. In such a case, sufficient contrast cannot be obtained.

In the above conventional techniques, when the gray-scale level value of transmittance exceeds the displayable range of the liquid crystal panel, the gray-scale level values of RGB subpixels are corrected independently of one another. Therefore, each subpixel has different correction gain, and color drift is caused between the input image and the output image.

SUMMARY OF THE INVENTION

According to an aspect of the present invention, there is provided with an image display device which includes; a backlight, a light modulator, a determiner, an intensity distribution estimator, a detector, a transmittance corrector, a gray-scale level corrector, a signal corrector, a light modulation controller and a backlight controller. The backlight is capable of controlling light intensity. The light modulator modulates a transmittance of light from the backlight. The determiner determine light intensity of the backlight based on luminance values of an input image. The intensity distribution estimator estimates intensity distribution of the light from the backlight in each pixel position of the light modulator when the backlight irradiates light having the light intensity determined by the determiner to the light modulator. The detector detects a maximum signal value from signal values of RGB subpixels forming each pixel of the input image. The transmittance corrector calculates a corrected transmittance by converting the signal value of each subpixel of the input image in accordance with the light intensity in each pixel position of the input image estimated by the intensity distribution. The gray-scale level corrector calculates a maximum corrected value by correcting the corrected transmittance of the subpixel having the maximum signal value in a displayable range of the light modulator. The signal corrector calculates a corrected value by calculating a gain between the corrected transmittance and the maximum corrected value of the subpixel having the maximum signal value and multiplying the corrected transmittance of each subpixel excepting the subpixel having the maximum signal value by the gain. The light modulation controller drives and controls the light modulator so that an image in accordance with the corrected value and the maximum corrected value of each subpixel is displayed. The backlight controller controls the backlight so that the backlight emits light having the light intensity determined by the determiner.

According to an aspect of the present invention, there is provided with an image display device which includes; a backlight, a light modulator, a determiner, an intensity distribution estimator, a detector, a transmittance corrector, a gray-scale level corrector, a signal corrector, a light modulation controller and a backlight controller. The backlight has a plurality of light sources, light intensity of each of the light sources being capable of being controlled. The light modulator modulates a transmittance of light from the backlight. The determiner determines light intensity of each of the light sources based on pixel values of the input image displayed in areas near each of the light sources. The intensity distribution estimator estimates intensity distribution of the light from the backlight in each pixel position of the light modulator when each of the light sources irradiates light having the light intensity determined by the determiner to the light modulator. The detector detects a maximum signal value from signal values of RGB subpixels forming each pixel of the input image. The transmittance corrector calculates a corrected transmittance by converting the signal value of each subpixel of the input image in accordance with the light intensity in each pixel position of the input image estimated by the distribution. The gray-scale level corrector calculates a maximum corrected value by correcting the corrected transmittance of the subpixel having the maximum signal value in a displayable range of the light modulator. The signal corrector calculates a corrected value by calculating a gain between the corrected transmittance of the subpixel having the maximum signal value and the maximum corrected value and multiplying the corrected transmittance of each subpixel excepting the subpixel having the maximum signal value by the gain. The light modulation controller drives and controls the light modulator so that an image having pixel values in accordance with the corrected value and the maximum corrected value of each subpixel is displayed. The backlight controller controls the light sources so that the light sources emit light having the light intensity determined by the determiner.

According to an aspect of the present invention, there is provided with an image display device which includes: a backlight, a light modulator, a determiner, an intensity distribution estimator, a first corrector, a detector, a gray-scale level corrector, a second corrector, a light modulation controller, and a backlight controller. The backlight has a plurality of light sources having two or more colors, light intensity of each of the light sources being capable of being controlled. The light modulator modulates a transmittance of light from the backlight. The determiner determines light intensity of each of the light sources based on pixel values of the input image displayed in areas near each of the light sources. The intensity distribution estimator estimates, for each color of the light sources, intensity distribution of the light from the backlight in each pixel position of the light modulator when the light source of the color irradiates light having the light intensity determined by the determiner to the light modulator. The first corrector calculates a corrected transmittance by converting the signal value of each of the RGB subpixels of the input image in accordance with the intensity of the light of each color in each pixel position of the input image estimated based on the intensity distribution from the backlight. The detector detects a maximum corrected transmittance from the corrected transmissivities of the RGB subpixels of each pixel. The gray-scale level corrector calculates a maximum corrected value by correcting the maximum corrected transmittance in a displayable range of the light modulator. The second corrector calculates a corrected value by calculating a gain between the maximum corrected transmittance and the maximum corrected value and multiplying the corrected transmittance of each subpixel excepting the subpixel having the maximum corrected transmittance by the gain. The light modulation controller drives and controls the light modulator so that an image having pixel values in accordance with the corrected value and the maximum corrected value of each subpixel is displayed. The backlight controller controls the light sources so that the light sources emit light having the light intensity determined by the determiner.

DETAILED DESCRIPTION OF THE INVENTION

Embodiments according to the present invention will now be explained. In the following explanation, the same symbols will be assigned to the same components and overlapped explanations will be partially omitted.

First Embodiment

Figure 1:
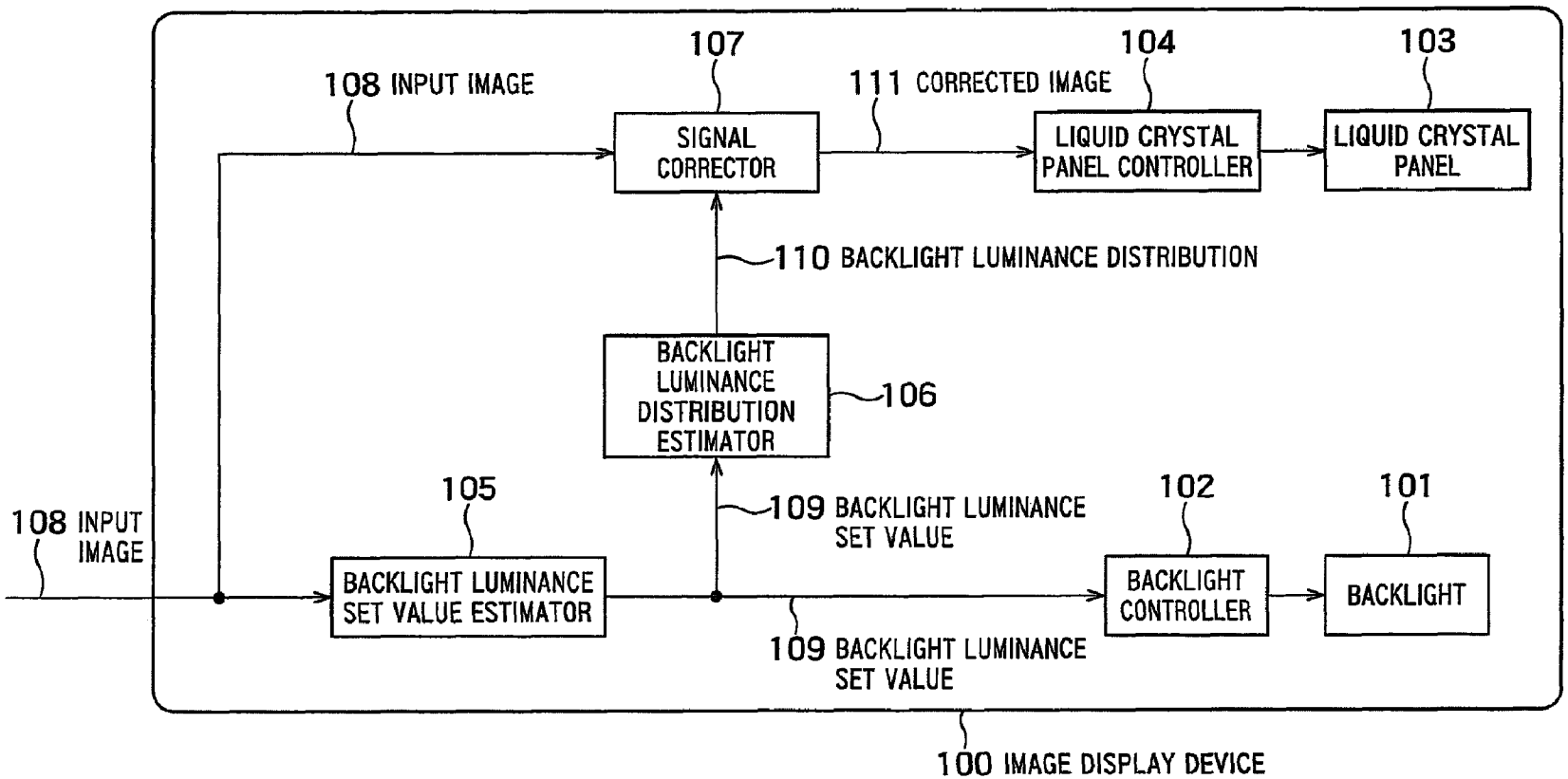
FIG. 1 is a block diagram of an image display device according a first embodiment.

FIG. 1 is a diagram showing an image display device 100 according to the present embodiment.

The image display device 100 includes: a backlight 101 which has a white light source and which can change the intensity of light to be emitted (hereinafter, referred to as backlight luminance) entirely and at one time; a backlight controller 102 for controlling the backlight 101; a liquid crystal panel 103 for modulating transmittance or reflectance of the light from the backlight 101; a liquid crystal panel controller 104 for driving and controlling the liquid crystal panel 103; a backlight luminance set value estimator 105 for calculating a light intensity of the backlight (hereinafter, referred to as a backlight luminance set value) 109 when displaying a frame (hereinafter, referred to as an input image) 108 of a input video signal; a backlight luminance distribution estimator 106 for estimating intensity distribution (hereinafter, referred to as backlight luminance distribution) 110 of the light emitted to the liquid crystal panel 103 when the backlight 101 irradiates light in accordance with the backlight luminance set value 109; and a signal corrector 107 for obtaining a corrected image 111 having corrected liquid crystal transmittance.

Figure 2:
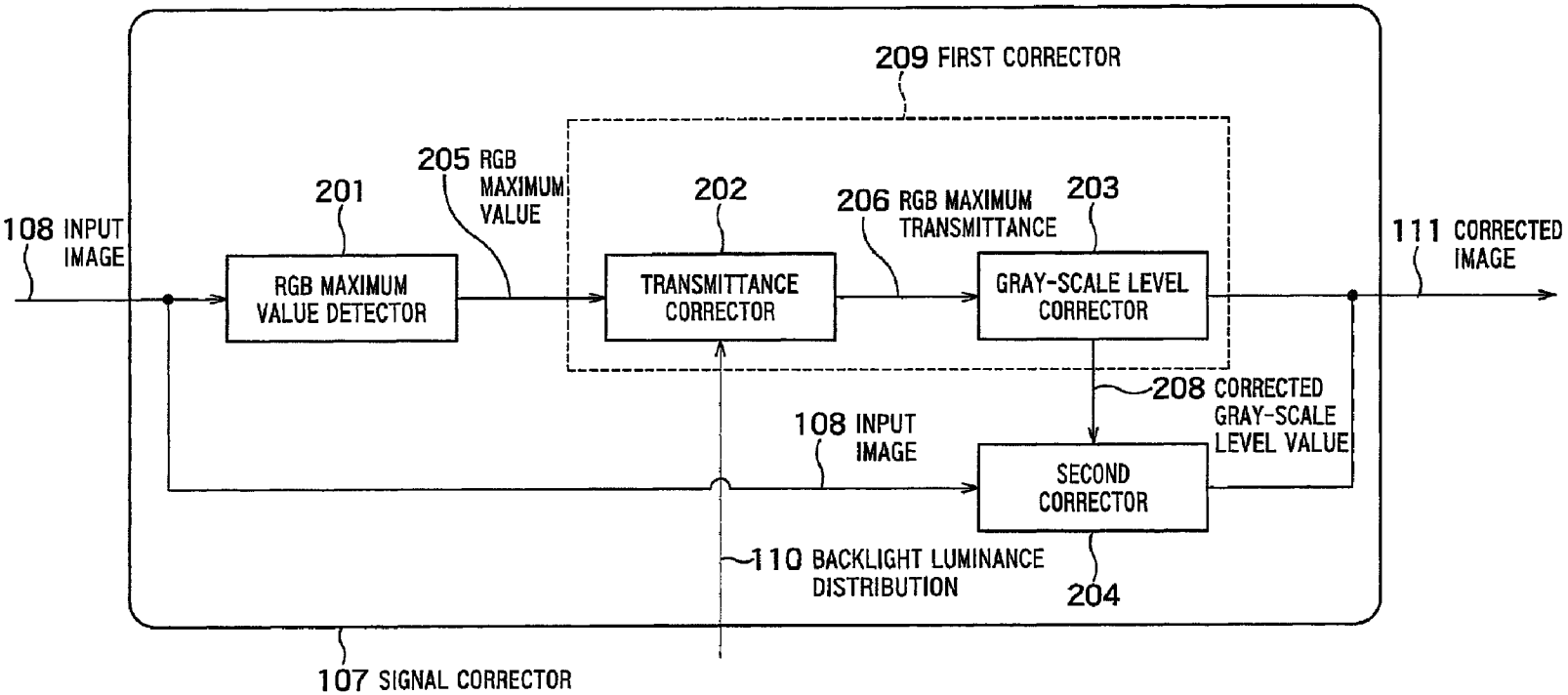
FIG. 2 is a block diagram of a signal corrector according to the first embodiment.

FIG. 2 is a diagram showing the signal corrector 107 in detail. The signal corrector 107 includes: an RGB maximum value detector 201 for detecting the maximum value (hereinafter, referred to as an RGB maximum value 205) from signal values of RGB subpixels forming each pixel of the input image; a first corrector 209 for obtaining a corrected gray-scale level value 208 by correcting the signal value of the subpixel having the RGB maximum value 205; and a second corrector 204 for correcting, in accordance with the corrected gray-scale level value 208, the liquid crystal transmittance of each subpixel excepting the subpixel having the RGB maximum value 205.

The first corrector 209 includes: a transmittance corrector 202 for obtaining an RGB maximum transmittance 206 by acquiring the backlight luminance in each pixel position based on the backlight luminance distribution 110 and by correcting, in accordance with the backlight luminance distribution 110, the transmittance of the subpixel having the RGB maximum value 205 so that display is performed in accordance with the input image when the backlight luminance enters the liquid crystal panel 103; and a gray-scale level corrector 203 for calculating the corrected gray-scale level value 208 by correcting the RGB maximum transmittance 206 into the displayable transmittance range when the RGB maximum transmittance 206 exceeds the displayable transmittance of the liquid crystal panel 103.

Next, the operation of the image display device 100 according to the present embodiment will be explained in detail.

Figure 3:
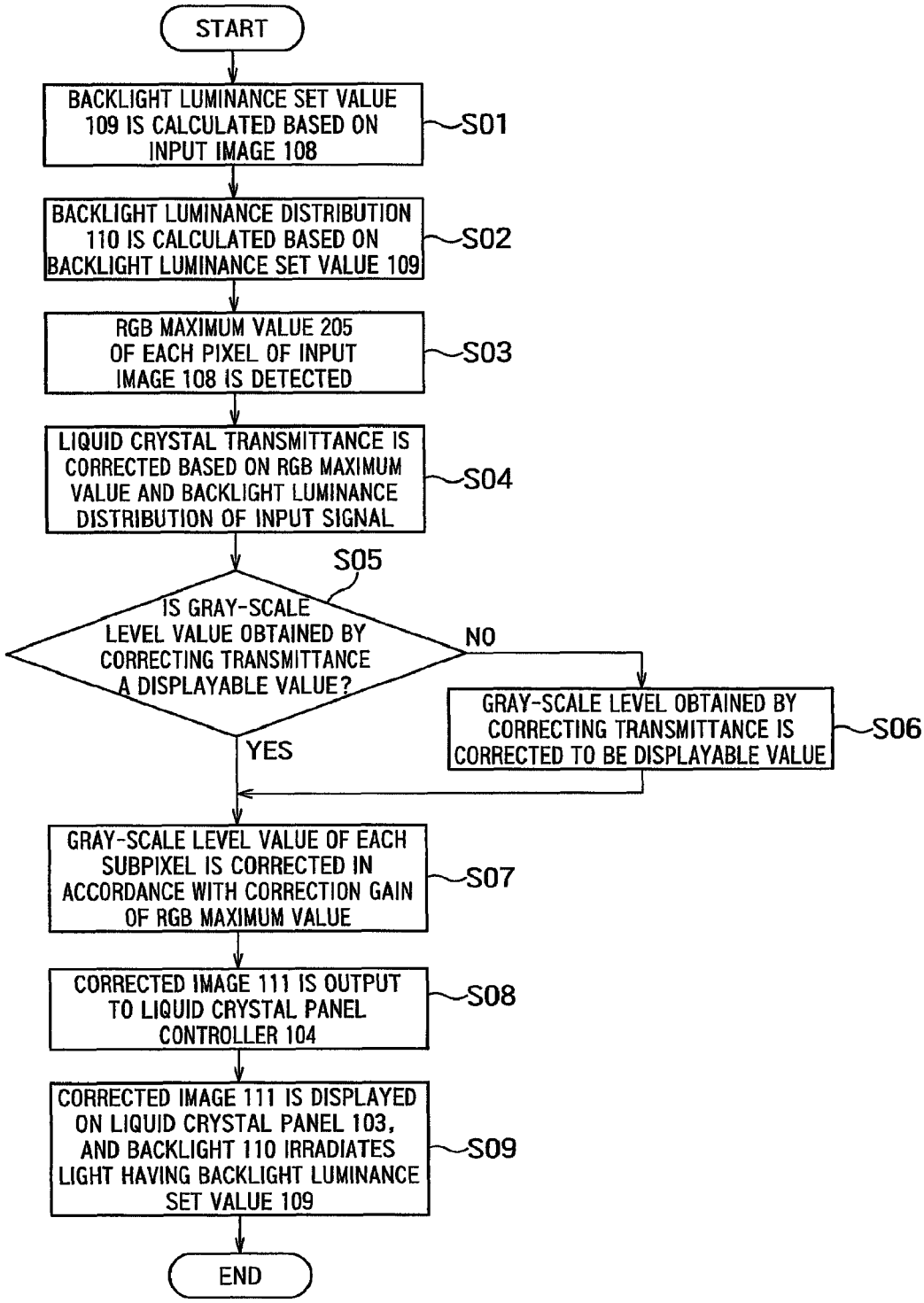
FIG. 3 is a process flow chart of the image display device according to the first embodiment.

FIG. 3 is a flow chart showing the operation of the image display device 100 according to the present embodiment.

First, the backlight luminance set value estimator 105 calculates the backlight luminance set value 109 based on the input image 108 (S01). The backlight luminance set value estimator 105 performs gamma conversion, as expressed by formula (1), on an input gray-scale level value for controlling the liquid crystal transmittance of each pixel of the input image 108, by which the input gray-scale level value is converted into a luminance value $L_{in}$.

$$L_{in} = \left(\frac{S_{in}}{255}\right)^{\gamma} \tag{1}$$

$S_{in}$, represents the input gray-scale level value, $L_{in}$ represents an input luminance value, and $\gamma$ represents a gamma coefficient. The gamma conversion can be calculated by using formula (1), or by referring to a previously prepared lookup table in which the gray-scale level value and the luminance value are related to each other. The input gray-scale level value of every pixel of the input image 108 is converted into the luminance value to obtain the backlight luminance set value 109. At this time, as shown by formula (2), the backlight luminance set value 109 is generally obtained from the mean value or the maximum value of the luminance values of all pixels of the input image 108.

$$BL_{mean}=L_{mean}\times DR_{half}$$

$$BL_{max}=L_{max} \tag{2}$$

$BL_{mean}$ and $BL_{max}$ represent the backlight luminance set value by a mean base and the backlight luminance set value by a maximum base respectively, and $L_{mean}$ and $L_{max}$ represent the mean value and the maximum value of the luminance values in the screen respectively. Further, $DR_{half}$ represents a value which is half the dynamic range of the liquid crystal panel 103. Note that the backlight luminance can be determined based on various methods other than the above method.

Next, the backlight luminance distribution estimator 106 estimates luminance 110 (hereinafter, referred to as the backlight luminance distribution) of the light emitted to each pixel position of the liquid crystal panel 103 when the backlight 101 irradiates light to the liquid crystal panel 103 in accordance with the backlight luminance set value 109 (S02). The backlight luminance distribution estimator 106 calculates, by formula (3), backlight luminance distribution $BL_{panel}(x, y)$, based on which light is irradiated to the liquid crystal panel 103 when the backlight 101 is illuminated with the backlight luminance set value 109.

$$BL_{panel}(x, y) = \sum_{j=0}^{N-1}\sum_{i=0}^{M-1} P(i, j)\cdot BL\left(x - \frac{(M-1)}{2} + i,\ y - \frac{(N-1)}{2} + j\right) \tag{3}$$

($M$ and $N$ are odd numbers)

M represents the size in the horizontal direction of the emission luminance distribution while N represents the size in the vertical direction of the emission luminance distribution. BL(x, y) represents the backlight luminance set value 109 of the backlight 101 in the nearest position to the coordinate (x, y), and its value is determined to be $BL_{mean}$ or $BL_{max}$ regardless of the coordinate (x, y). Further, P(x, y) represents the luminance value of the emission luminance distribution in a position (x, y) of the image. In the present embodiment, the luminance distribution (emission luminance distribution) measured when the backlight 101 irradiates a previously predetermined light is retained in a lookup table (not shown in the drawings), and the backlight luminance set value 109 is subjected to a convolution operation. Calculated in this way is the backlight luminance distribution 110 of the light irradiated to the liquid crystal panel 103 when lightning up the backlight 101 with the backlight luminance set value 109. When the backlight 101 is designed so that the emission distribution is equalized, $BL_{panel}(x, y)$ has the same value regardless of the position.

Next, the RGB maximum value detector 201 detects the RGB maximum value 205 of the input image 108 (S03). Note that when the input image 108 is based on a YUV format, signal conversion is performed to convert the YUV format into the RGB format.

Next, in accordance with the backlight luminance distribution 110 calculated in step S02, the RGB maximum transmittance 206 is calculated by correcting the liquid crystal transmittance of the RGB maximum value 205 detected in step S03 (S04). When the RGB maximum value 205 of the pixel in the position (x, y) of the input image 108 is set as $L_{max}(x, y)$, the maximum of the luminance value of the subpixel to be displayed on the liquid crystal panel 103 is also set as $L_{max}$ (x, y). Generally, the luminance value D(x, y) of the subpixel displayed on the liquid crystal panel 103 is expressed as in formula (4) by using value $BL_{panel}(x, y)$ of the backlight luminance distribution 110 obtained by the backlight luminance distribution estimator 106 and transmittance T(x, y) of the liquid crystal.

$$D(x,y)=BL_{panel}(x,y)\cdot T(x,y) \tag{4}$$

$D(x, y)=L_{max}$ (x, y) in the subpixel having the RGB maximum value 205. Accordingly, when the RGB maximum transmittance 206 of the subpixel having the RGB maximum value 205 is set as $T_{max}$ (x, y), $T_{max}$ (x, y) is calculated as expressed by formula (5).

$$T_{max}(x, y) = \frac{L_{max}(x, y)}{BL_{panel}(x, y)} \tag{5}$$

The liquid crystal transmittance can be corrected by using formula (5), or by referring to a previously prepared lookup table in which the RGB maximum value, the backlight luminance distribution value, and the RGB maximum transmittance are related to one another in order to obtain the RGB maximum transmittance.

Next, the gray-scale level corrector 203 judges whether the RGB maximum transmittance 206 calculated in step S04 is a displayable value on the liquid crystal panel 103 (S05). The gray-scale level value displayed on the liquid crystal panel 103 in accordance with RGB maximum transmittance $T_{max}$ (x, y) is set as $S_{out_max}(x, y)$. When the value of backlight luminance value $BL_{panel}(x, y)$ is small, there is a case where $S_{out_max}(x, y)$ become a value exceeding the displayable range of the liquid crystal panel 103.

When the RGB maximum transmittance 206 exceeds the displayable value of the liquid crystal panel 103 (S05, No), the gray-scale level corrector 203 corrects the RGB maximum transmittance 206 to a displayable value (S06). Concretely, when the liquid crystal panel 103 exceeds the displayable range, display is carried out with gray-scale level value $S'_{out_max}(x, y)$, which is the maximum displayable value (hereinafter, this process is referred to as a clipping process). For example, when the liquid crystal panel 103 displays 8-bit data, there is a case where $S_{out_max}(x, y)$ has a value greater than 255. When the calculated $S_{out_max}(x, y)$ has a value greater than $S'_{out_max}(x, y)=255$, which is a displayable gray-scale level value of the liquid crystal panel 103, $S_{out_max}(x, y)$ is set to be 255, which is the maximum displayable value of the liquid crystal panel 103, by performing the clipping process using a preset maximum value.

In the present embodiment, the gray-scale level is corrected by performing the clipping process. However, the gray-scale level can be corrected by rounding the gray-scale level value in the displayable range in accordance with a characteristic with respect to the gray-scale level value of the RGB maximum transmittance showing that the inclination of the curve becomes gradual as the gray-scale level value approaches a higher value, or in accordance with a characteristic with respect to the gray-scale level value of the RGB maximum transmittance showing that the curve is linear when the gray-scale level value is low, the curve is rounded when the input value is a high gray-scale level value, and that the inclination of the curve becomes gradual as the gray-scale level value approaches a higher value.

When the RGB maximum transmittance 206 does not exceed the displayable value of the liquid crystal panel 103 (S05, Yes), the RGB maximum transmittance 206 is directly transmitted to the second corrector as the corrected gray-scale level value 208.

Next, the second corrector 204 calculates a correction gain between the corrected gray-scale level value 208 and the input gray-scale level value of the RGB maximum value (S06). Correction gain G is calculated, as expressed by formula (6), by dividing corrected gray-scale level value $S_{out_max}(x, y)$ of the subpixel having the RGB maximum value 205 by uncorrected gray-scale level value $S_{in_max}(x, y)$.

$$G = \frac{S_{out_max}}{S_{in_max}} \tag{6}$$

Next, in accordance with the correction gain G of the RGB maximum value calculated in step S06, the second corrector 204 corrects the gray-scale level values of the subpixels excepting the subpixel having the RGB maximum value (S07). When the gray-scale level values of uncorrected RGB subpixels of the input image 108 are set as $S_{in_R}(x, y)$, $S_{in_G}(x, y)$, and $S_{in_B}(x, y)$ respectively and the gray-scale level values of corrected RGB subpixels are set as $S_{out_R}(x, y)$, $S_{out_G}(x, y)$, and $S_{out_B}(x, y)$ respectively, the gray-scale level values are corrected as expressed by formulas (7).

$$S_{out_R}(x,y)=G\times S_{in_R}(x,y)$$

$$S_{out_G}(x,y)=G\times S_{in_G}(x,y) \tag{7}$$

$$S_{out_B}(x,y)=G\times S_{in_B}(x,y)$$

The corrected image 111 having $S_{out_R}(x, y)$, $S_{out_G}(x, y)$, and $S_{out_B}(x, y)$ calculated by the second corrector 204 is transmitted to the liquid crystal panel controller 104 (S08).

The liquid crystal panel controller 104 displays the corrected image 111 on the liquid crystal panel 103, and the backlight controller 102 controls the backlight 101 so that the backlight 101 irradiates light having the luminance in accordance with the backlight luminance set value 109 (S09). Then, the flow ends.

Next, the effect of the subpixel correction performed in steps S07 and S08 will be explained.

Figure 4:
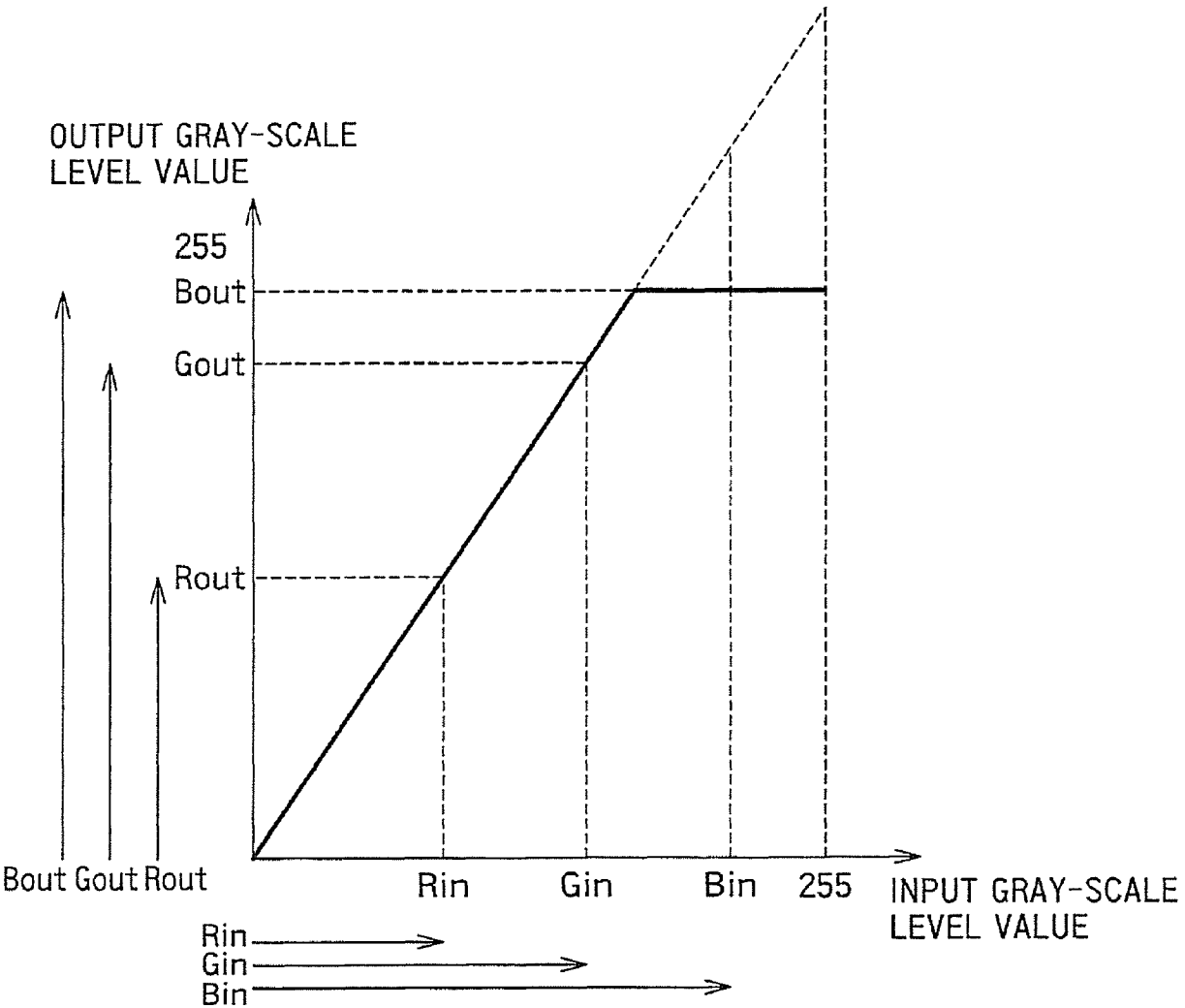
FIG. 4 shows an example of a color drift caused by clipping gray-scale level correction.

FIG. 4 is a diagram showing an example of a color drift caused when performing a clipping process on all subpixels.

Figure 5:
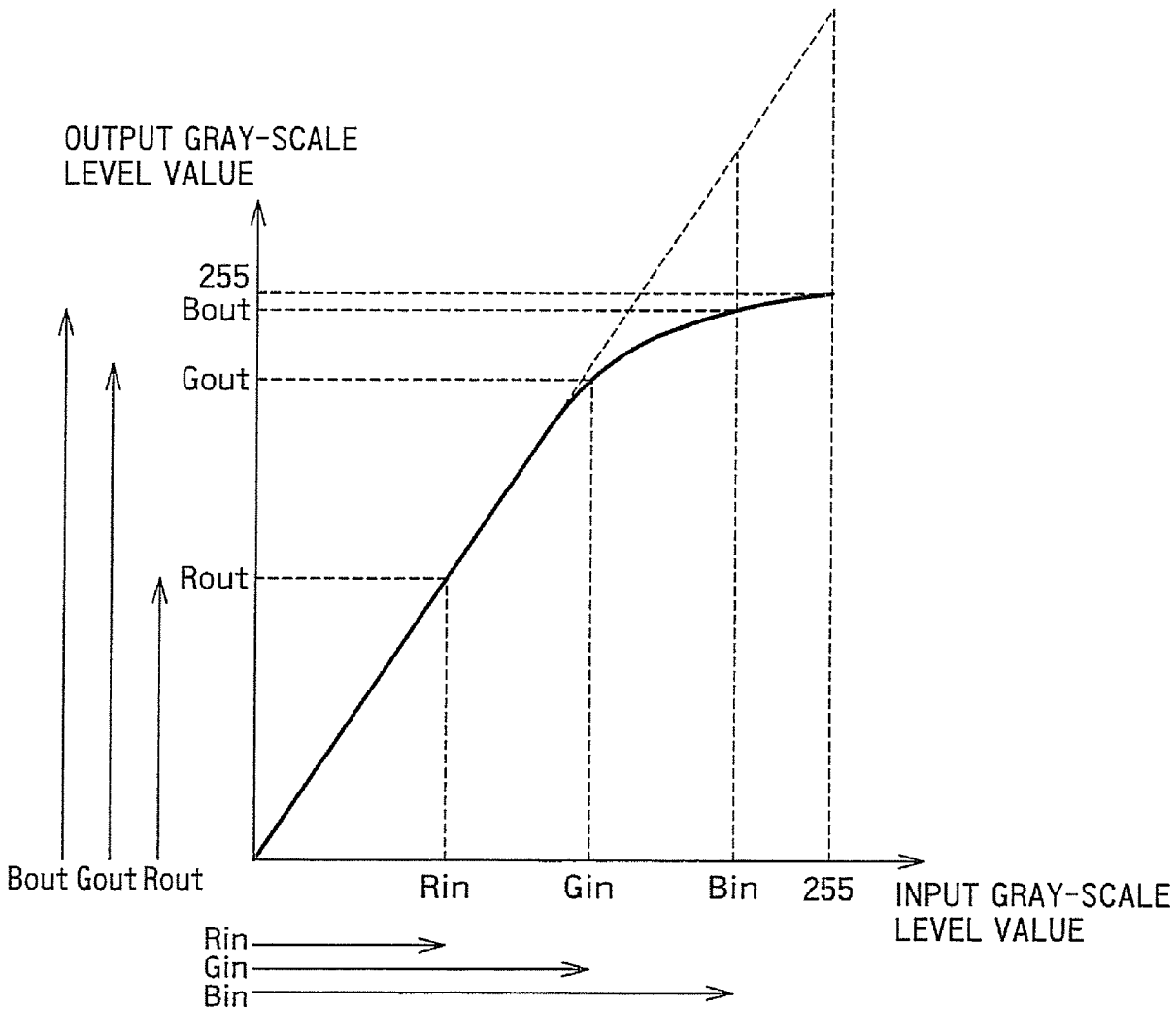
FIG. 5 shows an example of a color drift caused by rounding gray-scale level correction.

FIG. 5 is a diagram showing an example of a color drift caused when performing a rounding gray-scale level correction on all subpixels.

Both of FIG. 4 and FIG. 5 show that when the input gray-scale level values are corrected by the clipping or rounding process to generate the output gray-scale level values, the color balance among the RGB subpixels having the input gray-scale level values ($R_{in}$, $G_{in}$, and $B_{in}$) and that having the output gray-scale level values ($R_{out}$, $G_{out}$, and $B_{out}$) are inconsistent with each other.

On the other hand, in the present embodiment, the color drift can be prevented by correcting the proportion among the subpixels having the corrected gray-scale level values ($R_{out}$, $G_{out}$, and $B_{out}$) in accordance with the proportion among the subpixels having the gray-scale level values of the input image 108.

Figure 6:
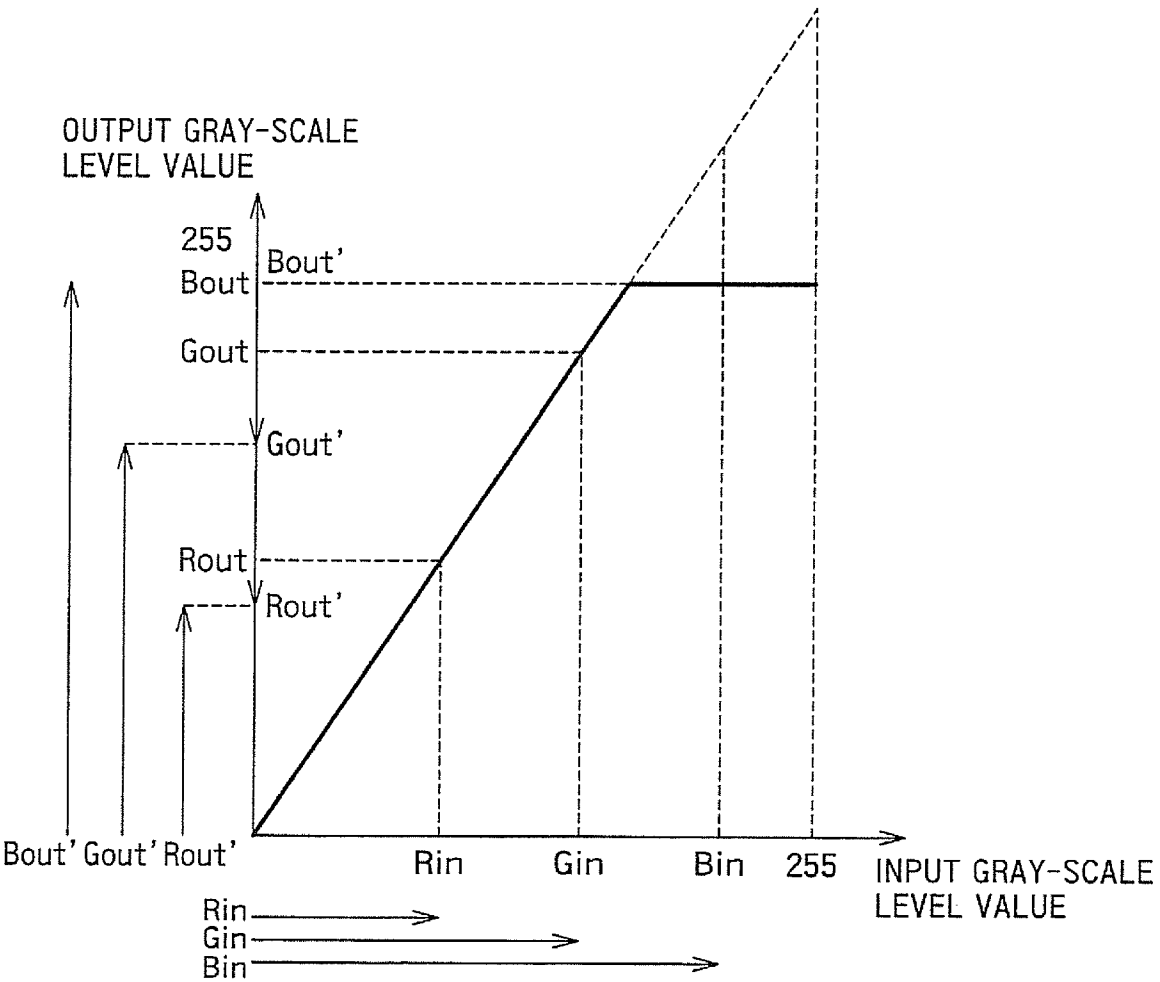
FIG. 6 shows an example in which the clipping gray-scale level correction is performed while retaining RGB proportion.

FIG. 6 is a diagram showing an example in which the clipping gray-scale level correction is performed while keeping the proportion of each RGB subpixel.

Figure 7:
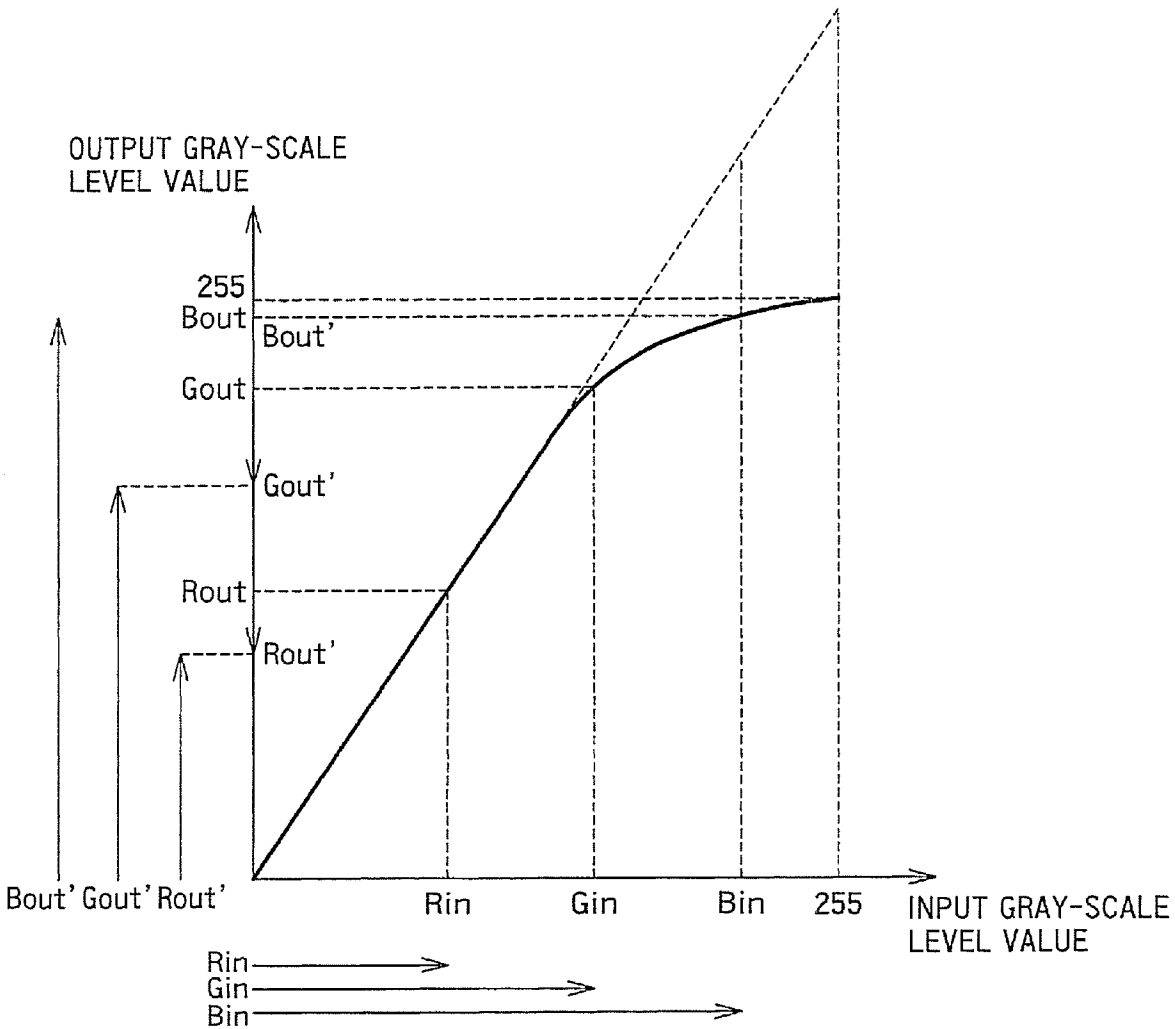
FIG. 7 shows an example in which the rounding gray-scale level correction is performed while retaining RGB proportion.

FIG. 7 is a diagram showing an example in which the rounding gray-scale level correction is performed while keeping the proportion of each RGB subpixel.

By correcting the gray-scale level value as expressed by formula (7), the output gray-scale level value of each RGB subpixel of each pixel can be obtained in the same proportion as the input gray-scale level value. The color drift recognized when comparing the corrected image 111 and the input image 108 can be prevented by matching the proportion of the gray-scale level value of each corrected RGB subpixel with the proportion of the gray-scale level value of each RGB subpixel of the input image 108.

Further, the first corrector 209 can calculate the corrected gray-scale level value by using the RGB maximum value 205 and a function unifying the processes of the transmittance corrector 202 and the gray-scale level corrector 203. Furthermore, the corrected gray-scale level value can be calculated by referring to a prepared lookup table in which the RGB maximum value 205, a value of the backlight luminance distribution 110, and the corrected gray-scale level value 208 are related to one another.

As stated above, according to the present embodiment, the liquid crystal transmittance is corrected in accordance with the backlight luminance distribution while retaining the proportion of the gray-scale level value of each RGB subpixel of the input signal, by which a high contrast image can be displayed without causing color drift in the image to be displayed regardless of the luminance distribution of the backlight.

Second Embodiment

A second embodiment will be explained. The configuration of the image display device in the present embodiment is similar to that shown in FIG. 1 of the first embodiment. In the first embodiment, the backlight is modulated to irradiate light having the same luminance to the entire liquid crystal panel. The present embodiment is different from the first embodiment in that the backlight has a plurality of light sources each of which has controllable light intensity.

The input image 108 is input into the backlight luminance set value estimator 105. As in the first embodiment, the backlight luminance set value estimator 105 obtains the input luminance value $L_{in}$. The area of the input image displayed in the near position to each light source is predetermined with respect to each light source, and the backlight luminance set value 109 of each light source is calculated in accordance with the pixels of each area. As shown in formula (8), the backlight luminance set value 109 of each light source is obtained from the mean value or the maximum value of the luminance values of the pixels in each area. Here, n represents an index given to the area corresponding to each light source.

$$BL_{mean}(n)=L_{mean}(n)\times DR_{half}$$

$$BL_{max}(n)=L_{max}(n) \tag{8}$$

$BL_{mean}$ (n) and $BL_{max}$ (n) represent the backlight luminance set value 109 by a mean base in the area n and the backlight luminance set value 109 by a maximum base in the area n, respectively. $L_{mean}$ (n) and $L_{max}$ (n) represent the mean value and the maximum value of the luminance values in the area n, respectively. Further, $DR_{half}$ represents a value which is half the dynamic range of the liquid crystal.

The backlight luminance distribution estimator 106 obtains backlight luminance $BL_{panel}(x, y)$ in the position (x, y) by performing a convolution operation as shown in formula (9) on the backlight luminance set value 109 and emission luminance distribution of the backlight previously obtained in each area n.

$$BL_{panel}(x, y) = \sum_{j=0}^{N-1}\sum_{i=0}^{M-1} P(i, j)\cdot BL\left(x - \frac{(M-1)}{2} + i, y - \frac{(N-1)}{2} + j\right) \tag{9}$$

($M$ and $N$ are odd numbers)

M represents the size in the horizontal direction of the emission luminance distribution while N represents the size in the vertical direction of the emission luminance distribution. BL (x, y) represents the backlight luminance set value in the area in which the coordinate (x, y) is included, and P(i, j) represents the luminance value of the emission luminance distribution in the position (i, j). Further, with respect to the area situated in the periphery of the image, $BL_{panel}(x, y)$ serving as the backlight luminance set value 109 is obtained by specularly reflecting the backlight luminance set value 109 and by performing the convolution operation as expressed by formula (9).

The backlight luminance distribution 110 calculated by the backlight luminance distribution estimator 106 is input into the signal corrector 107. As in the first embodiment, transmittance is corrected based on the input image 108 and the backlight luminance distribution 110 while retaining the proportion of each RGB subpixel of each pixel of the input image, by which the corrected image 111 is obtained.

The corrected image 111 corrected by the signal corrector 107 is transmitted to the liquid crystal panel controller 104. The liquid crystal panel controller 104 displays the transmitted corrected image 111 on the liquid crystal panel 103.

As stated above, according to the present embodiment, even when the backlight has a plurality of light sources and the backlight luminance distribution is not equalized in the screen, the liquid crystal transmittance is corrected retaining the proportion of the gray-scale level value of each RGB subpixel of the input signal, by which the image can be displayed without causing color drift in the image to be displayed regardless of the luminance distribution of the backlight.

Third Embodiment

In the first and second embodiments, the backlight 101 has a white light source having one color. On the other hand, in the image display device of the present embodiment, the backlight 101 has light sources having a plurality of colors. An example in which a plurality of light sources having three primary colors of RGB will be explained. The light intensity of each light source of each color can be controlled independently.

Figure 8:
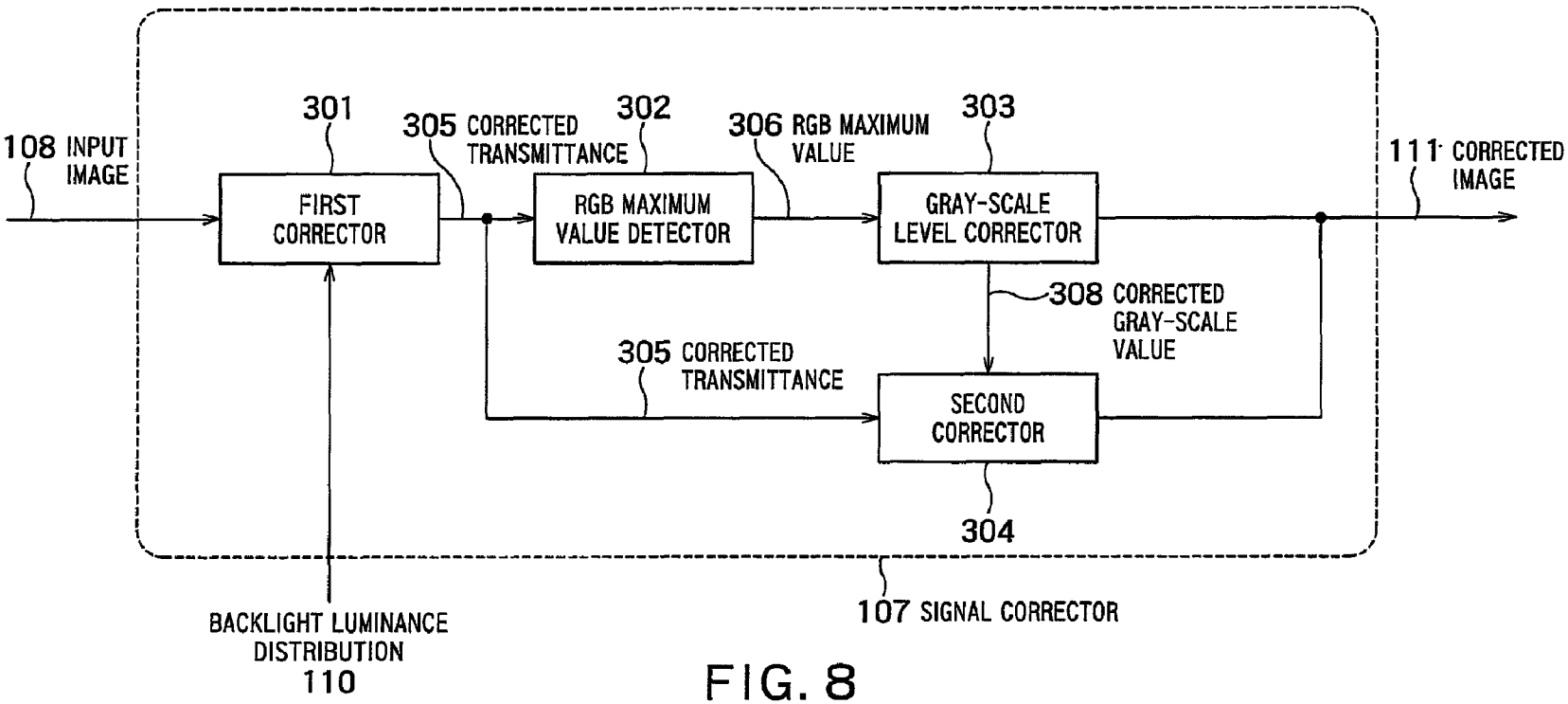
FIG. 8 is a block diagram of a signal corrector according to a third embodiment.

FIG. 8 is a diagram showing the structure of the signal corrector 107, which is different from that in the first embodiment. Each of $BL_{panel_R}(x, y)$, $BL_{panel_G}(x, y)$, and $BL_{panel_B}(x, y)$ represents the emission intensity of each colored light source emitted to the position (x, y) on the liquid crystal panel 103. The emission intensity distribution 110 of each colored light source is input into the signal corrector 107 together with the input image 108.

A first corrector corrects the transmittance of the input image 108.

The transmittance of the input image 108 is corrected. Here, the gray-scale level values of the RGB subpixels of the input image 108 are set as $S_{in_R}(x, y)$, $S_{in_G}(x, y)$, and $S_{in_B}(x, y)$ respectively, and corrected transmittance values 305 of the RGB subpixels are set as $S_{out_R}(x, y)$, $S_{out_G}(x, y)$, and $S_{out_B}(x, y)$ respectively.

Further, vectors $\overrightarrow{S_{in}(x,y)}$, $\overrightarrow{S_{out}(x,y)}$, and $\overrightarrow{BL_{panel}(x,y)}$ are expressed as $$\overrightarrow{S_{in}(x,y)}=(S_{in_R}(x,y),S_{in_G}(x,y),S_{in_B}(x,y),$$

$$\overrightarrow{S_{out}(x,y)}=(S_{out_R}(x,y),S_{out_G}(x,y),S_{out_B}(x,y), \text{ and}$$

$$\overrightarrow{BL_{panel}(x,y)}=BL_{panel_R}(x,y),BL_{panel_G}(x,y),BL_{panel_B}(x,y),$$

the corrected transmittance 305 of each RGB subpixel can be calculated as expressed by formula (10).

$$\overrightarrow{S_{out}(x,y)}=F(\overrightarrow{S_{in}(x,y)},\overrightarrow{BL_{panel}(x,y)}) \tag{10}$$

Note that the function F is a function to obtain the corrected gray-scale level value of each RGB subpixel expressing the luminance and chromaticity of the input image as the output image, based on the input gray-scale level value of each RGB subpixel and the emission intensity of each colored light source. Therefore, if light having each of the corrected gray-scale level values $S_{out_R}(x, y)$, $S_{out_G}(x, y)$, and $S_{out_B}(x, y)$ is irradiated with the emission intensity of distribution $\overrightarrow{BL_{panel}(x,y)}$ an image in which RGB subpixel proportion is same as that of gray-scale level values of the input image can be displayed. The corrected transmittance 305 is calculated and input into an RGB maximum value detector 302 to detect an RGB maximum value 306, which is the maximum gray-scale level value in the corrected gray-scale level values of the subpixels. The RGB maximum value 306 is input into a gray-scale level corrector 303.

Here, the maximum value in $S_{out_R}(x, y)$, $S_{out_G}(x, y)$, and $S_{out_B}(x, y)$ is $S_{out_max}(x, y)$.

When $S_{out_max}(x, y)$ serving as the RGB maximum value 306 exceeds a displayable value, the gray-scale level corrector 303 sets $S_{out_max}(x, y)$ to be a displayable value $S'_{out_max}(x, y)$. For example, in a liquid crystal panel displaying 8-bit data, when $S_{out_max}(x, y)$ has a value of 255 or greater, $S'_{out_max}(x, y)$ is set to be 255, which is the maximum displayable value in the gray-scale level values expressed by the 8-bit liquid crystal panel. In the above example, the gray-scale level is corrected by performing the clipping process. However, the gray-scale level corrector 303 can correct the gray-scale level by rounding the gray-scale level value in the displayable range in accordance with a characteristic with respect to the input gray-scale level value showing that the inclination of the curve becomes gradual as the gray-scale level value approaches a higher value, or in accordance with a characteristic with respect to the input gray-scale level value showing that the curve is linear when the gray-scale level value is low, the curve is rounded when the input value is a high gray-scale level value, and that the inclination of the curve becomes gradual as the gray-scale level value approaches a higher value.

A corrected gray-scale level value 308 obtained by the gray-scale level corrector 303 is input into a second corrector 304 together with the corrected transmittance 305. The second corrector obtains the correction gain G as expressed by formula (11).

$$G = \frac{S'_{out_max}}{S_{in_max}} \tag{11}$$

The gray-scale level values of $S_{out_R}(x, y)$, $S_{out_G}(x, y)$, and $S_{out_B}(x, y)$ obtained by formula (10) are corrected as expressed by formula (12) based on the correction gain G calculated in formula (11).

$$S'_{out_R}(x,y)=G\times S_{out_R}(x,y)$$

$$S'_{out_G}(x,y)=G\times S_{out_G}(x,y) \tag{12}$$

$$S'_{out_R}(x,y)=G\times S_{out_B}(x,y)$$

As shown in formula (10), the corrected gray-scale level values $S_{out_R}(x, y)$, $S_{out_G}(x, y)$, and $S_{out_B}(x, y)$, are calculated so that an image having the same RGB subpixel proportion as the input image can be displayed with the calculated emission intensity of each colored light source. Further, as shown in formula (12), the gray-scale level value is corrected to be included in the displayable range while retaining the proportion of $S_{out_R}(x, y)$, $S_{out_G}(x, y)$, and $S_{out_B}(x, y)$. Accordingly, even when the backlight has light sources having three colors, the output image can be displayed without causing color drift when comparing the output image with the input image. In the present embodiment, the backlight has the light sources having three colors. However, the backlight can have light sources having four or more colors. Further, one or plurality of light sources can be arranged.

Figure 9:
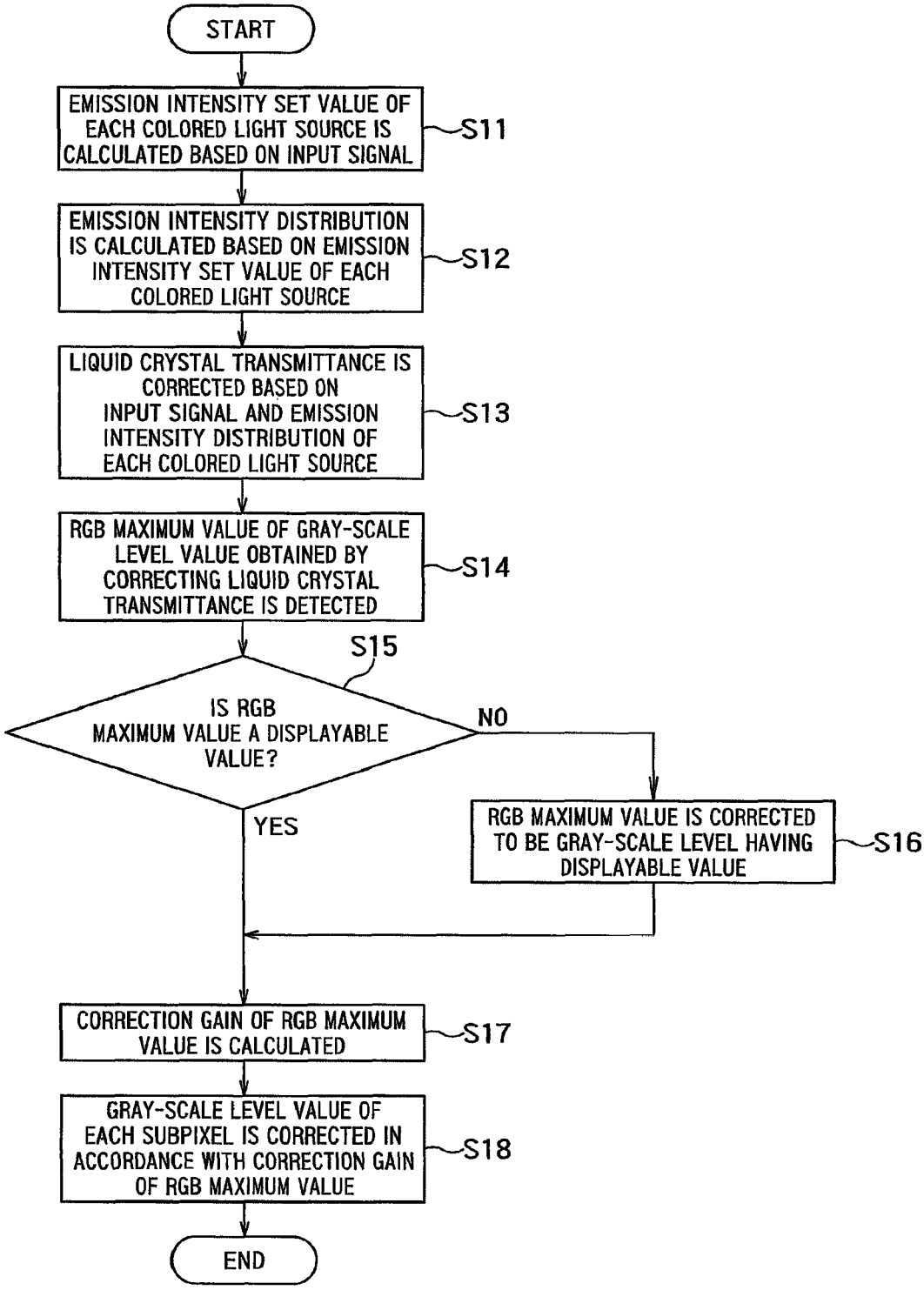
FIG. 9 is a process flow chart of the image display device according to the third embodiment.

FIG. 9 shows a flow chart of the image display device according to the present embodiment.

First, the emission intensity set value of each colored light source is calculated based on the input signal (S11).

Next, the emission intensity distribution of each colored light source is calculated based on the emission intensity set value of each colored light source and the emission luminance distribution of each colored light source previously retained (S12).

Next, the liquid crystal transmittance is corrected based on the input gray-scale level value and the emission intensity distribution of each colored light source so that the luminance and chromaticity of the input image are displayed in the output image (S13).

Next, the RGB maximum value of the gray-scale level value obtained by correcting the liquid crystal transmittance in step S13 is detected (S14).

Next, whether or not the gray-scale level value having the RGB maximum value detected in step S14 is a displayable value of the liquid crystal panel is judged (S15).

When the result of the judgment in step S15 is Yes, the flow proceeds to step S17. When the result of the judgment is No, the gray-scale level value having the RGB maximum value is corrected to be the gray-scale level value having a displayable value of the liquid crystal panel (S16).

Next, the correction gain is calculated based on the RGB maximum gray-scale level value corrected in step S16 and the uncorrected RGB maximum gray-scale value (S17). Then, the gray-scale level value of each subpixel corrected in step S13 is corrected in accordance with the correction gain (S18).

As stated above, according to the present embodiment, even when the backlight has light sources having a plurality of colors and the backlight luminance distribution is not equalized in the screen, the liquid crystal transmittance is corrected retaining the proportion of the gray-scale level value of each RGB subpixel of the input signal, by which the image can be displayed without causing color drift in the image to be displayed.

What is claimed is:

1. An image display device, comprising:

a backlight capable of controlling light intensity;

a light modulator configured to modulate a transmittance of light from the backlight;

a determiner configured to determine light intensity of the backlight based on luminance values of an input image;

an intensity distribution estimator configured to estimate intensity distribution of the light from the backlight in each pixel position of the light modulator when the backlight irradiates light having the light intensity determined by the determiner to the light modulator;

a detector configured to detect a maximum signal value from signal values of RGB subpixels forming each pixel of the input image;

a transmittance corrector configured to calculate a corrected transmittance by converting the signal value of each subpixel of the input image in accordance with the light intensity in each pixel position of the input image estimated by the intensity distribution;

a gray-scale level corrector configured to calculate a maximum corrected value by correcting the corrected transmittance of the subpixel having the maximum signal value in a displayable range of the light modulator;

a signal corrector configured to calculate a corrected value by calculating a gain between the corrected transmittance and the maximum corrected value of the subpixel having the maximum signal value and multiplying the corrected transmittance of each subpixel excepting the subpixel having the maximum signal value by the gain;

a light modulation controller configured to drive and control the light modulator so that an image in accordance with the corrected value and the maximum corrected value of each subpixel is displayed; and a backlight controller configured to control the backlight so that the backlight emits light having the light intensity determined by the determiner.

2. The device according to claim 1, wherein the corrected transmittance calculated so that the image to be displayed is in accordance with the input image when the light modulator is irradiated with the light intensity of the backlight exceeds the displayable range of the light modulator, the gray-scale level corrector calculates the maximum corrected value by correcting the corrected transmittance of the subpixel having the maximum signal value to a maximum value in the displayable range of the light modulator.

3. The device according to claim 1, wherein the corrected transmittance calculated so that the image to be displayed is in accordance with the input image when the light modulator is irradiated with the light intensity of the backlight exceeds the displayable range of the light modulator, the gray-scale level corrector calculates the maximum corrected value based on a function having a characteristic of approaching asymptotically to a maximum value in the displayable range of the light modulator as the corrected transmittance becomes large.

4. An image display device comprising:

a backlight having a plurality of light sources, light intensity of each of the light sources being capable of being controlled;

a light modulator configured to modulate a transmittance of light from the backlight;

a determiner configured to determine light intensity of each of the light sources based on pixel values of the input image displayed in areas near each of the light sources;

an intensity distribution estimator configured to estimate intensity distribution of the light from the backlight in each pixel position of the light modulator when each of the light sources irradiates light having the light intensity determined by the determiner to the light modulator;

a detector configured to detect a maximum signal value from signal values of RGB subpixels forming each pixel of the input image;

a transmittance corrector configured to calculate a corrected transmittance by converting the signal value of each subpixel of the input image in accordance with the light intensity in each pixel position of the input image estimated by the distribution;

a gray-scale level corrector configured to calculate a maximum corrected value by correcting the corrected transmittance of the subpixel having the maximum signal value in a displayable range of the light modulator;

a signal corrector configured to calculate a corrected value by calculating a gain between the corrected transmittance of the subpixel having the maximum signal value and the maximum corrected value and multiplying the corrected transmittance of each subpixel excepting the subpixel having the maximum signal value by the gain;

a light modulation controller configured to drive and control the light modulator so that an image having pixel values in accordance with the corrected value and the maximum corrected value of each subpixel is displayed; and a backlight controller configured to control the light sources so that the light sources emit light having the light intensity determined by the determiner.

5. An image display device comprising:

a backlight having a plurality of light sources having two or more colors, light intensity of each of the light sources being capable of being controlled;

a light modulator configured to modulate a transmittance of light from the backlight;

a determiner configured to determine light intensity of each of the light sources based on pixel values of the input image displayed in areas near each of the light sources;

an intensity distribution estimator configured to estimate, for each color of the light sources, intensity distribution of the light from the backlight in each pixel position of the light modulator when the light source of the color irradiates light having the light intensity determined by the determiner to the light modulator;

a first corrector configured to calculate a corrected transmittance by converting the signal value of each of the RGB subpixels of the input image in accordance with the intensity of the light of each color in each pixel position of the input image estimated based on the intensity distribution from the backlight;

a detector configured to detect a maximum corrected transmittance from the corrected transmissivities of the RGB subpixels of each pixel;

a gray-scale level corrector configured to calculate a maximum corrected value by correcting the maximum corrected transmittance in a displayable range of the light modulator;

a second corrector configured to calculate a corrected value by calculating a gain between the maximum corrected transmittance and the maximum corrected value and multiplying the corrected transmittance of each subpixel excepting the subpixel having the maximum corrected transmittance by the gain;

a light modulation controller configured to drive and control the light modulator so that an image having pixel values in accordance with the corrected value and the maximum corrected value of each subpixel is displayed; and a backlight controller configured to control the light sources so that the light sources emit light having the light intensity determined by the determiner.

* * * * *